US007874436B2

(12) United States Patent
Hought

(10) Patent No.: US 7,874,436 B2
(45) Date of Patent: Jan. 25, 2011

(54) SADDLE RACK

(76) Inventor: Perry Hought, 525 Water St., Elko, NV (US) 89801

( * ) Notice: Subject to any disclaimer, the term of this patent is extended or adjusted under 35 U.S.C. 154(b) by 509 days.

(21) Appl. No.: 11/669,858

(22) Filed: Jan. 31, 2007

(65) Prior Publication Data

US 2007/0187345 A1 Aug. 16, 2007

Related U.S. Application Data

(60) Provisional application No. 60/772,028, filed on Feb. 10, 2006.

(51) Int. Cl.
*A47F 7/00* (2006.01)

(52) U.S. Cl. ..... 211/85.11; 211/1.51

(58) Field of Classification Search ..... 211/85.11, 211/80, 81, 63, 1.51, 1.56, 87.01, 96, 166, 211/1.57, 46
See application file for complete search history.

(56) References Cited

U.S. PATENT DOCUMENTS 3,315,819 A * 4/1967 Kingsbery ..... 211/163
3,699,578 A * 10/1972 Fiorentino ..... 361/161
3,811,574 A * 5/1974 O'Brien ..... 211/85.11
4,125,908 A * 11/1978 Vail et al. ..... 5/83.1
4,329,928 A * 5/1982 Shaw ..... 108/106
5,292,011 A * 3/1994 Kostigian ..... 211/48
6,189,706 B1 * 2/2001 Akins ..... 211/87.01
6,880,675 B2 * 4/2005 Huang ..... 182/195
6,995,682 B1 * 2/2006 Chen et al. ..... 340/825.72
7,500,573 B1 * 3/2009 Flynn ..... 211/85.11
2004/0211738 A1 * 10/2004 Priefert ..... 211/85.11

OTHER PUBLICATIONS

*JR Products Low Profile Bumper Door Holder*; http://www.folandsales.com/catalog.asp?prodid=488100; Jan. 30, 2007; 1 page.

* cited by examiner

*Primary Examiner*—Darnell M Jayne
*Assistant Examiner*—Devin Barnett
(74) *Attorney, Agent, or Firm*—Workman Nydegger

(57) ABSTRACT

A storage system may include a rack. The rack may include one or more saddle supports sized and configured to support at least a portion of a saddle. The rack may be sized and configured to move between an extended position and a retracted position. The rack may be sized and configured to move among a plurality of heights. The storage system may include a height adjustment device sized and configured to adjust the height of the rack.

16 Claims, 3 Drawing Sheets

SADDLE RACK

CROSS-REFERENCE TO RELATED APPLICATIONS

This applications claims priority to, and the benefit of, U.S. provisional patent application Ser. No. 60/772,028, filed Feb. 10, 2006 and entitled SADDLE RACK, the disclosure of which is incorporated by reference in its entirety.

BACKGROUND OF THE INVENTION

1. Field of the Invention

The present invention generally relates to racks and, in particular, to a rack designed to stack saddles.

2. Description of Related Art

Those who have horses understand how important a saddle is when riding a horse. For example, the saddle protects the horse from the discomfort of a rider, and provides the rider with stability and additional control over the horse.

Unfortunately, saddles can be extremely heavy and burdensome, as well as expensive. One who has spent a large amount of money on a saddle does not want to be tossing the saddle on the ground where it may get scratched, dirty or broken. Furthermore, because of the weight of a saddle, constantly having to retrieve a saddle from off the ground or from a high shelf may cause unnecessary strain on one's body.

In addition, it is common for many riders to own more than one saddle. For example, a person may have multiple horses which each require a different saddle, some saddles are different styles such as the European style or the Western style, one saddle may be a "work" saddle and another saddle may be a "show" saddle, and/or a person may simply need an extra saddle as a replacement saddle. Because of these and other reasons, a rider may own multiple saddles that need to be stored. The size and bulkiness of the saddles may make the saddles difficult to store.

BRIEF SUMMARY OF EMBODIMENTS OF THE INVENTION

A need therefore exists for a storage system that eliminates or diminishes the disadvantages and problems described above.

One aspect is a device that may hold saddles off the ground in order to protect them from getting damaged as well as allowing for easier retrieval of the saddles without physical strain. The device may be a rack that is attached to a trailer, which may permit easy transportation of the saddle. The rack may also prevent the saddles from being thrown in the back of a truck or trailer, which could consequently damage the saddles. Furthermore, the rack could have several supports to allow for multiple saddles to be stacked.

Another aspect is a storage system that may include a rack. The rack may include one or more saddle supports sized and configured to support at least a portion of a saddle. The rack may also include one or more pad supports sized and configured to support at least a portion of one or more pads, such as a saddle pad and/or a saddle blanket.

Yet another aspect is a storage system that may include a rack sized and configured to swing, pivot and/or otherwise move between an extended position and a retracted position. Desirably, this may allow the rack to be moved to the extended position to facilitate loading or unloading of the rack and returned to the retracted position to store the loaded or unloaded rack.

A further aspect is a storage system that may include a mounting system comprising a rack and a mount connected to the rack. The mount may be pivotally or otherwise movably connected to a support surface or structure, which may help the mount and/or the rack swing, pivot and/or otherwise move between an extended position and a retracted position. The storage system may include a securing assembly sized and configured to secure the rack and/or the mount in the retracted position. The storage system may include a brace sized and configured to secure the rack and/or the mount in the extended position.

Still another aspect is a storage system that may include a rack sized and configured to slide or otherwise move among a plurality of heights. Because the rack may be positioned at plurality of heights, the rack may be more easily loaded and/or unloaded. The rack may also be sized and configured to pivot or otherwise move between an extended position and a retracted position.

Another aspect is a storage system that may include a rack and a height adjustment device sized and configured to adjust the height of the rack. For example, the height adjustment device may comprise a winch configured to raise and lower the rack. The height adjustment device may be motor driven.

These and other aspects, features and advantages of the present invention will become more fully apparent from the following detailed description of preferred embodiments and appended claims.

BRIEF DESCRIPTION OF THE DRAWINGS

The appended drawings contain figures of preferred embodiments to further illustrate and clarify the above and other aspects, advantages and features of the present invention. It will be appreciated that these drawings depict only preferred embodiments of the invention and are not intended to limit its scope. The invention will be described and explained with additional specificity and detail through the use of the accompanying drawings in which.

DETAILED DESCRIPTION OF THE PREFERRED EMBODIMENTS

Figure 2:
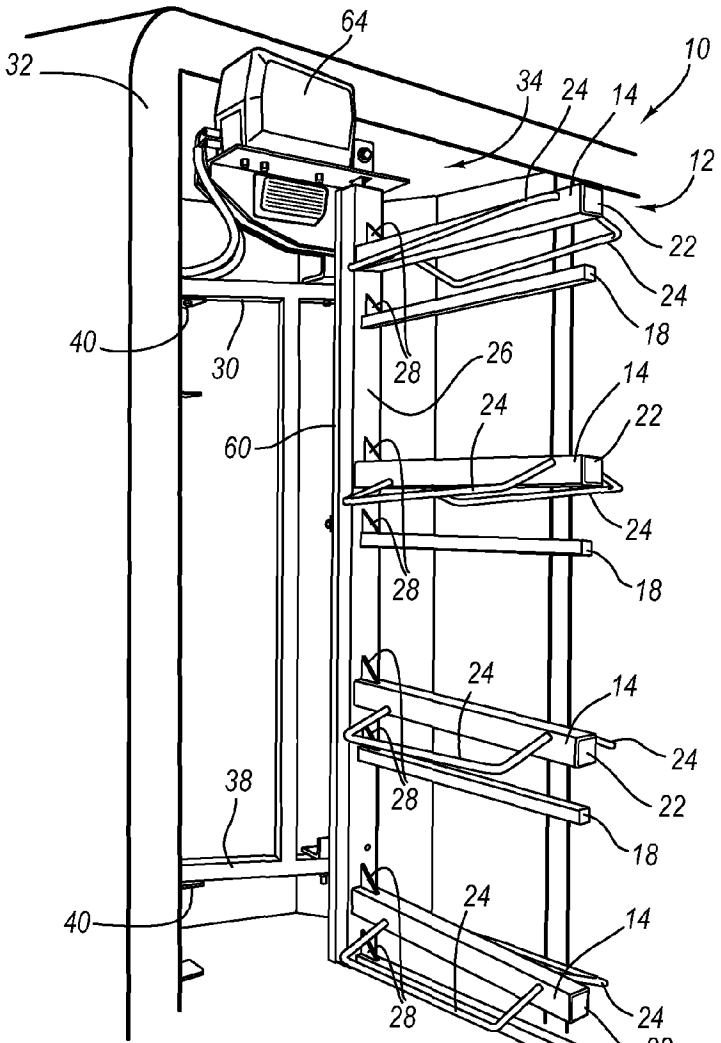
FIG. 2 is a perspective view of the storage system shown in FIG. 1, illustrating the saddle rack in an extended position.

The present invention is generally directed towards racks and, in particular, to a rack designed to stack saddles. The principles of the present invention, however, are not limited to racks designed to stack saddles. It will be understood that, in light of the present disclosure, the rack disclosed herein can be successfully used in connection with other types of storage and/or organization systems.

Additionally, to assist in the description of the rack, words such as top, bottom, front, rear, right and left may be used to describe the accompanying figures, which are not necessarily drawn to scale. It will be appreciated, however, that the rack can be located in a variety of desired positions—including various angles, sideways and even upside down. A detailed description of the rack now follows.

As shown in FIGS. 1-4, a storage system 10 may include a saddle rack 12. The rack 12 includes one or more saddle supports 14 sized and configured to support at least a portion of a saddle 16, which may be used for riding an animal, such as a horse. The rack 12 may also include one or more pad supports 18 sized and configured to support at least a portion of one or more pads 20, such as a saddle pad and/or a saddle blanket. Desirably, the saddle supports 14 and the pad supports 18 may be sized and configured to support, respectively, saddles and pads having a variety of sizes, shapes and/or configurations.

Figure 4:
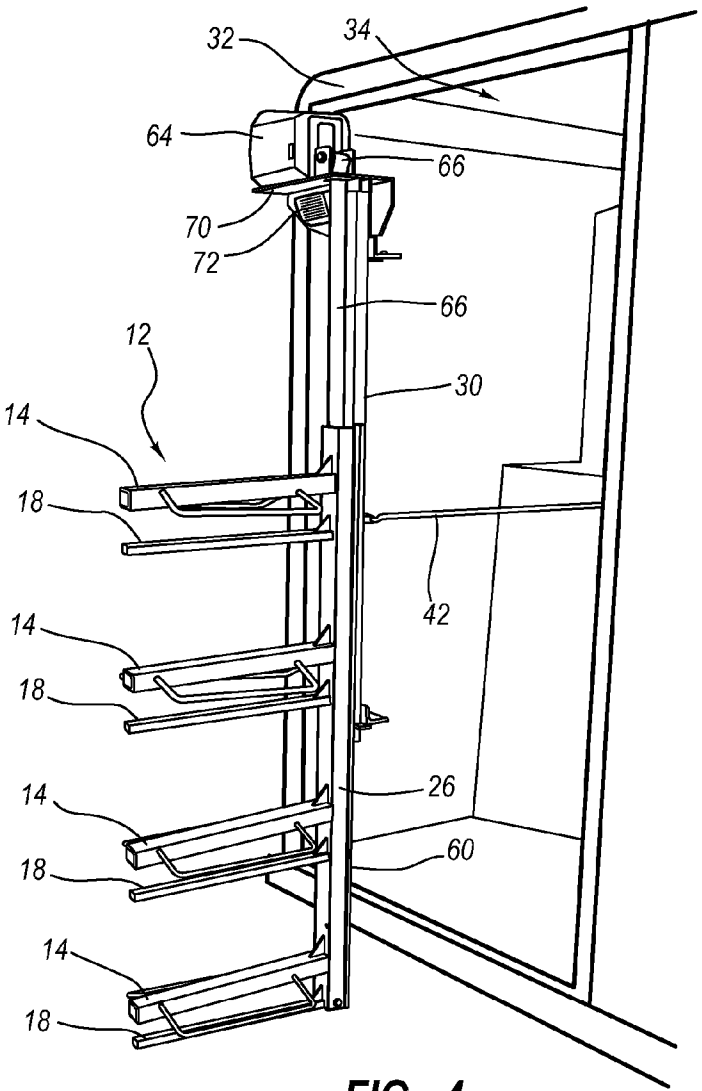
FIG. 4 is a perspective view of the storage system shown in FIG. 3.
Figure 3:
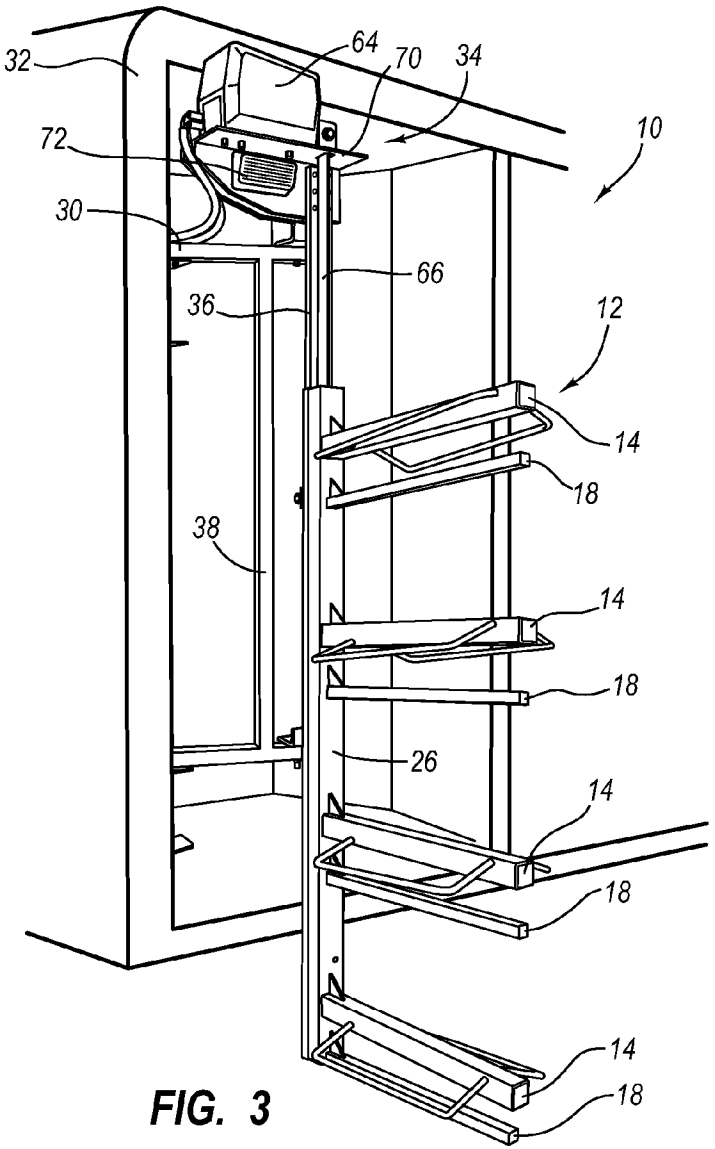
FIG. 3 is a perspective view of the storage system shown in FIG. 2, illustrating the saddle rack at a lower height.

The rack 12 may include a pad support 18 for each saddle support 14. For example, as best seen in FIGS. 2-4, the rack 12 preferably includes a pad support 18 that is spaced apart from and/or positioned below each saddle support 14. Desirably, with the pad supports 18 spaced apart from and/or positioned below corresponding saddle supports 14, the saddles 16 and the pads 20 may more quickly and easily dry.

In further detail, saddles may be placed upon the saddle supports 14 and pads may be placed upon the pad supports 18. With the saddles resting upon the saddle supports 14 and the pads resting upon the spaced-apart pad supports 18, air may more easily flow between the saddles and the pads. This increased air flow may allow the saddles and the pads to more quickly and easily dry, which may advantageously reduce the risk of mold and/or other moisture-related damage to the saddles and the pads. It will be appreciated that the rack 12 need not include a pad support 18 for each saddle support 14 and that the rack 12 may include any number of supports. It will also be appreciated that the rack 12 does not require any saddle supports 14 and/or any pad supports 18 depending upon, for example, the particular configuration of the rack.

The pad supports 18 may be spaced about 3 to 4 inches (preferably about 3.75 inches) below their corresponding saddle supports 14. Desirably, this may allow a greater space (about 11 inches or more) to be provided between the pad supports 18 and any saddle support below. It will be appreciated, however, that the supports 14, 18 may have other suitable spacing, including more spacing or less spacing.

The supports 14, 18 may have a variety of configurations. As shown in FIG. 2, the pad support 18 preferably comprises an elongated tube or rod, which may have a length of about 24 inches and a generally square cross-section of about 1 inch by 1 inch. The saddle support 14 preferably includes a central portion 22 and a plurality of lateral portions 24. The lateral portions 24 may slope in a generally downward direction at an angle of 35 to 55 degrees, preferably about 45 degrees. Desirably, this generally downward slope may help the central portion 22 and the lateral portions 24 support and/or maintain the saddle 16 in a desired shape and/or position. This downward slope, however, is not required. The central portion 22 of the saddle support 14 preferably comprises an elongated tube or rod, which may have a length of about 24 inches and a generally square cross-section of about 2 inches by 2 inches. The laterally extending portions 24 of the saddle support 14 preferably comprise elongated tubes or rods, which may have a generally circular cross-section of about ½ inch diameter and may have a generally U-shaped configuration. The central portion 22 and the laterally extending portions 24 may be separately formed components, which may be connected using one or more fasteners, connectors, adhesives, welds and/or other suitable means. However, the central portion 22 and the laterally extending portions 24 may be integrally formed as part of a unitary, one-piece structure. It will be appreciated that the supports 14, 18 may include other components having other suitable sizes, shapes and/or configurations.

As shown in FIGS. 1-5, the rack 12 may also include a base 26. The base 26 preferably comprises an elongated tube or rod, which may have a length of about 4 to 6 feet and a generally rectangular cross-section of about 2 inches by 3 inches. It will be appreciated that the base 26 may include other components having other suitable sizes, shapes and/or configurations.

The supports 14, 18 and the base 26 may be separately formed components, which may be connected using one or more fasteners, connectors, adhesives, welds and/or other suitable means. The saddle supports 14 and the pad supports 18 are preferably connected to the base 26 in a permanently fixed position using, for example, one or more welds. However, the saddle supports 14 and the pad supports 18 may be movably and/or adjustably connected to the base 26 using one or more fasteners, connectors, and/or other suitable means. Of course, the supports 14, 18 and the base 26 need not be separately formed and may, for example, be integrally formed as part of a unitary, one-piece structure.

As shown in FIG. 2, the rack 12 may include one or more reinforcing members, such as gussets 28. The gussets 28 may be connected to the saddle supports 14, the pad supports 18 and/or the base 26, which may reinforce the connection of the supports to the base 26. It will be appreciated, however, that the rack 12 does not require the gussets 28 or the base 26 depending upon, for example, the particular configuration of the rack.

As shown in FIGS. 1-4, a storage system 10 may include a mount 30 sized and configured to connect the rack 12 to a mounting surface or structure, such as a wall of a trailer 32, a wall of an enclosure, and/or any surface or structure to which the mount may be connected. In particular, the mount 30 may include a first portion connected to the rack 12 and a second portion connected to the mounting surface or structure.

Figure 1:
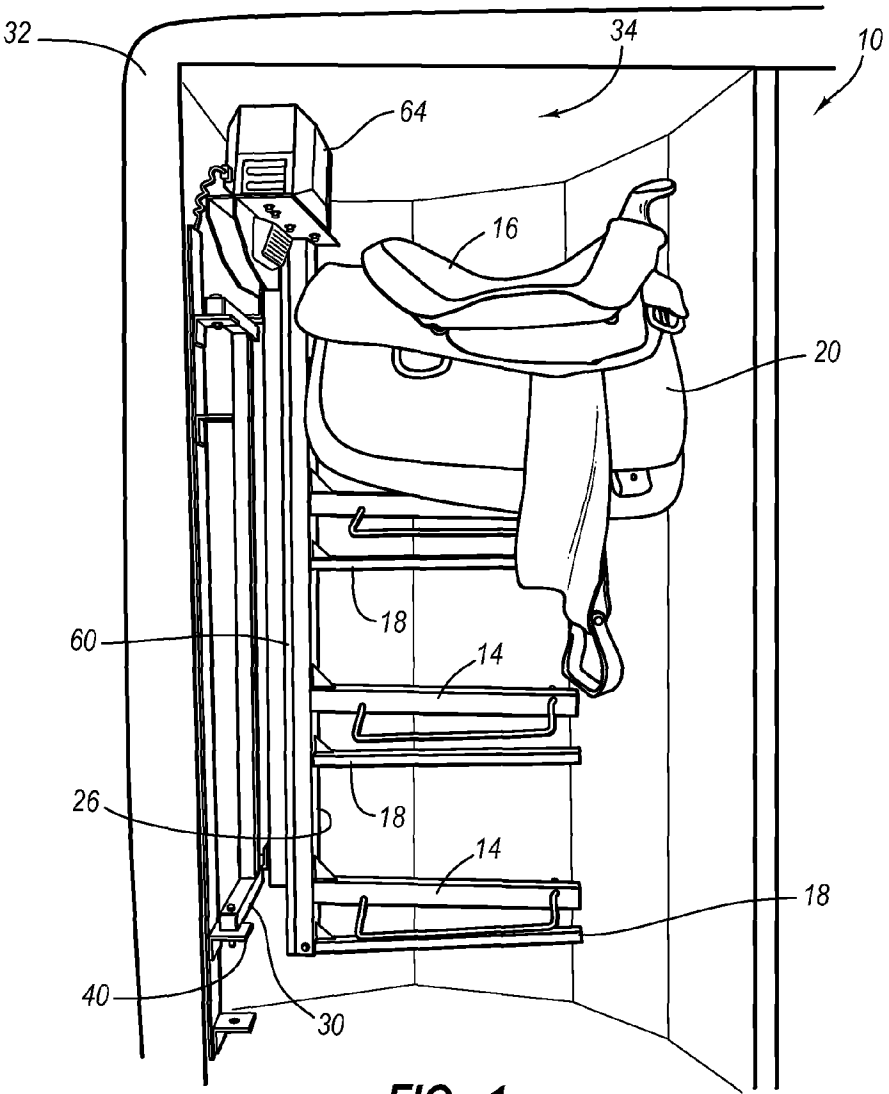
FIG. 1 is a perspective view of an exemplary storage system, illustrating an exemplary saddle rack in a retracted position.

The mount 30 is preferably sized and configured to swing, pivot and/or otherwise move between an extended position and a retracted position. Desirably, if the rack 12 is connected to the mount 30 and the mount may swing, pivot and/or otherwise move between an extended position and a retracted position, then the rack may also swing, pivot and/or otherwise move between an extended position and a retracted position. As shown in FIGS. 2-4, the rack 12 may swing to an extended position outside of a trailer 32 for convenient loading and/or unloading of the rack 12. After loading and/or unloading the rack 12, the rack may be swung back to a retracted position within the trailer 32 for storage. For instance, the rack 12 may be swung to a retracted position within trailer 32, such as within a tack room 34 of the trailer as shown in FIG. 1. It will be appreciated that the tack room 34 may be located proximate the front, the rear, the side and/or any other portion of the trailer 32.

Figure 5:
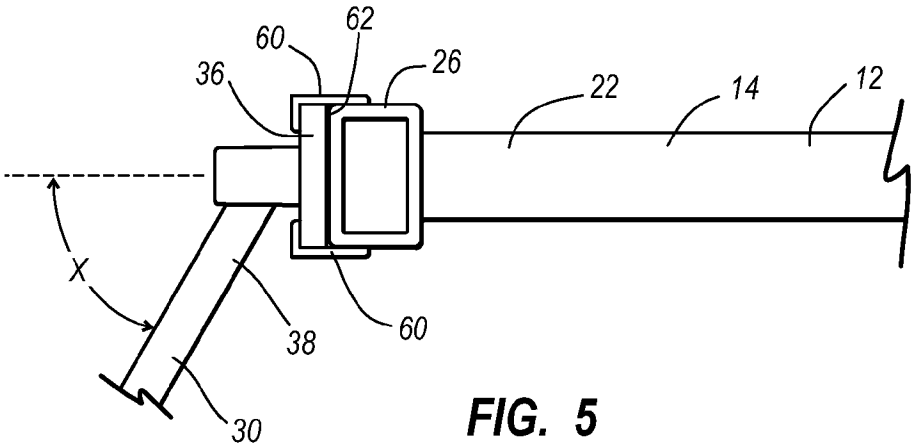
FIG. 5 is a top view of a portion of the storage system shown in FIG. 1, illustrating an exemplary connection of the saddle rack to an exemplary mount.

In greater detail, as shown in FIGS. 2, 3 and 5, the mount 30 may include a track 36 and a frame 38. The track 36 may be connected to frame 38 and a base 26 of the rack 12. A distance separates a lower end of the base from a lower end of the track when the saddle rack is in a lowered position; and an upper end of the base is spaced apart from an upper end of the track by the same distance when the saddle rack is in the lowered position. The frame 38 may be pivotally or otherwise movably connected to the mounting surface or structure (such as an interior wall of the tack room 34) using one or more brackets or connectors 40, as shown in FIGS. 1-2. Desirably, this may allow the rack 12 and the mount 30 to swing, pivot and/or otherwise move between an extended position and a retracted position. It will be appreciated, however, that the rack 12 and the mount 30 need not be sized and configured to swing, pivot or otherwise move between an extended position and a retracted position and may, for example, be configured to remain in a permanently fixed position, if desired.

Figure 6:
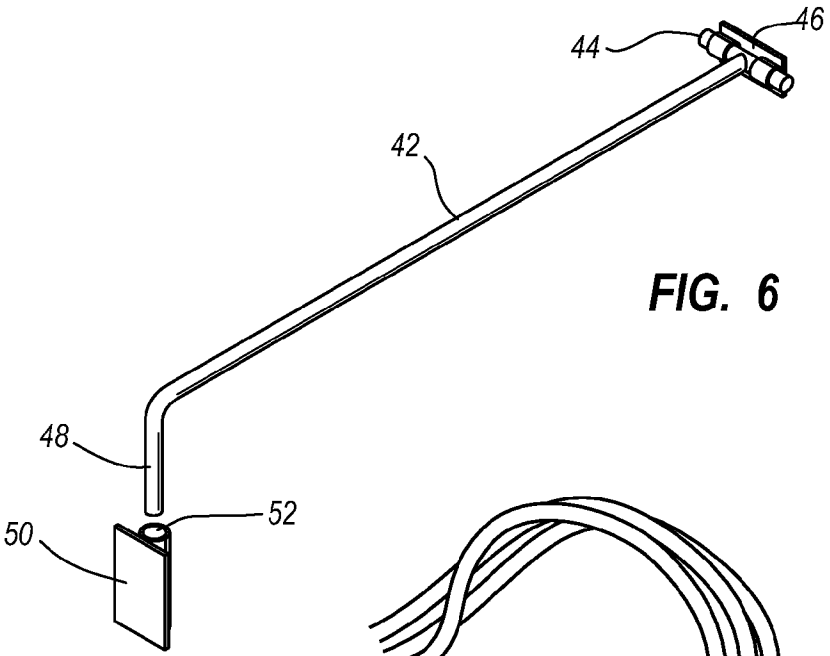
FIG. 6 is a perspective view of a portion of the storage system shown in FIG. 1, illustrating an exemplary brace.
Figure 8:
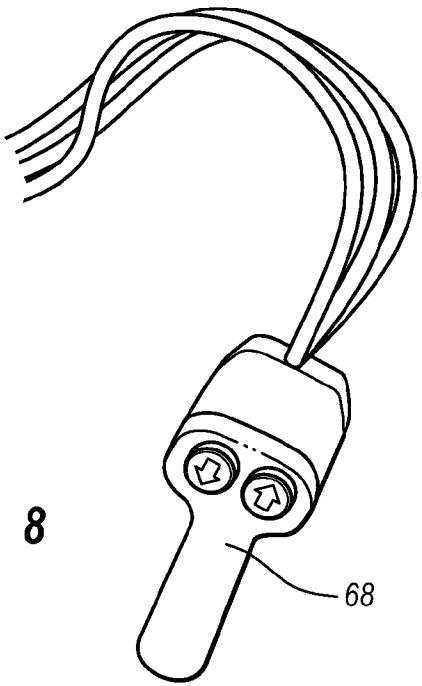
FIG. 8 is a perspective view of an exemplary control device.

As shown in FIGS. 4 and 6, the storage system 10 may include a brace 42 sized and configured to secure the rack 12 and/or the mount 30 in the extended position. In particular, the brace 42 may be moved between a first position in which the rack 12 and/or the mount 30 may freely move between the extended and retracted positions and a second position in which the rack and/or the mount are generally fixed in the extended position. For example, as shown in FIG. 6, the brace 42 may include a first end 44 that may be movably coupled to a portion of the trailer 32 using a bracket 46. The brace 42 may also include a second end 48 sized and configured to be selectively connected to and disconnected from a bracket 50 connected to the rack 12 and/or the mount 30. Accordingly, after moving the rack 12 and/or the mount 30 to the extended position, the end 48 of the brace 42 may be inserted into a receiving portion 52 of the bracket 50 to secure the rack 12 and/or the mount 30. Desirably, this may help prevent the rack 12 and/or the mount 30 from unintentionally moving while loading and unloading the rack. After loading or unloading the rack 12, the end 48 of the brace 42 may be removed from the receiving portion 52 of the bracket 50, which may allow the rack 12 and/or the mount 30 to be freely moved between the extended and retracted positions.

Figure 7:
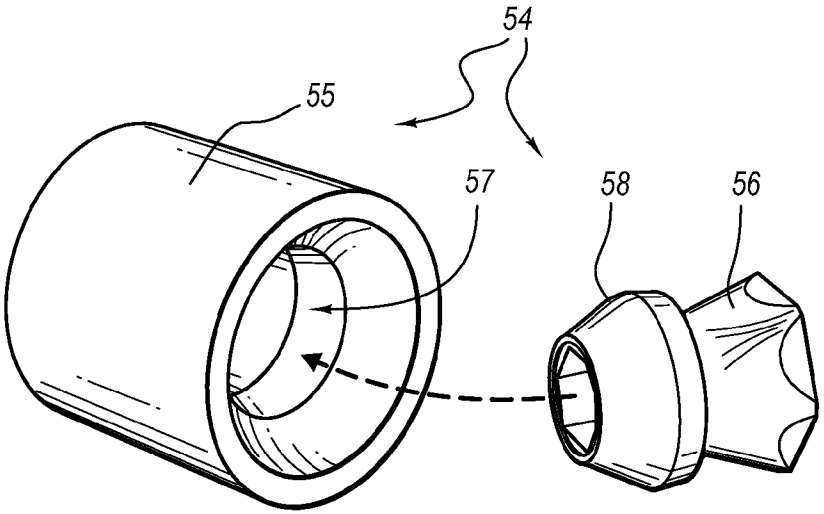
FIG. 7 is a cross-sectional view of an exemplary securing assembly.

As shown in FIG. 7, the storage system 10 may include a securing assembly 54 sized and configured to releasably secure the rack 12 and/or the mount 30 in the retracted position. In particular, the securing assembly 54 may include securing members 55, 56, one of which may be connected to the trailer 32 and the other may be connected to the rack 12 and/or the mount 30. For example, the securing member 55 may be connected to the trailer 32 and the securing member 56 may be connected to the mount 30. The securing member 55 preferably includes a receiving portion 57 sized and configured to receive and releasably retain a portion of the securing member 56 (such as a protrusion 58) using a suction fit; a snap fit; a friction fit and/or an interference fit. Portions of the securing members 55, 56 may deform and/or deflect to help the receiving portion 57 to receive and releasably retain a portion of the securing member 56.

As shown in FIG. 5, the mount 30 may be generally offset x degrees from the rack 12, where x is preferably about 78 degrees. The value of x could be larger or smaller depending, for example, upon the particular configuration of the mount 30. For example, the value of x could be between 40 to 85 degrees, between 40 to 80 degrees, less than 80 degrees and/or other suitable values. Desirably, the offset mount 30 may allow the rack 12 to be more easily accessible. It will be appreciated, however, that the mount 30 need not be offset from the rack 12.

The rack 12 is preferably sized and configured to move among a plurality of heights, such as a higher height shown in FIG. 2 and a lower height shown in FIGS. 3-4. Because the rack 12 may be moved among a plurality of heights, the rack may be more easily loaded and/or unloaded. For example, saddles and pads may be more easily loaded onto and off of the lower supports 14, 18 when the rack 12 is at a higher height and the higher supports 14, 18 when the rack 12 is at a lower height. If desired, the rack 12 may be sized and configured to move among a plurality of heights when in the extended position and/or when in the retracted position.

In further detail, as shown in FIGS. 1-5, the rack 12 may be slidably or otherwise movably connected to the mount 30, which may allow the rack to slide or otherwise move to any of a substantially continuous range of heights. For example, the track 36 may have an elongated, strip-shaped configuration, and the rack 12 may be slidably coupled to the track using one or more brackets 60, as shown in FIG. 5. The brackets 60 preferably have a generally L-shaped cross section and may be connected to the base 26 to form at least a part of a receiving portion 62 sized and configured to slidably receive at least a portion of the track 36.

As best seen in FIGS. 3 and 4, the storage system 10 may include a height adjustment device sized and configured to adjust the height of the rack 12, such as a winch 64. The winch 64 may include a drum and a strap 66, a cable, a chain or the like connected to the drum. The strap 66 may also be connected to the rack 12. For example, the base 26 of the rack 12 may be a tube and a portion of the strap may be disposed within the tube's hollow interior and may be connected to an interior wall of the tube, if desired.

The drum of the winch 64 may be rotated in a first direction to wrap the strap 66 around the drum, which may lift the rack 12 as the rack slides along the track 36 of the mount 30. The drum of the winch 64 may be rotated in an opposing, second direction to unwrap the strap 66 from the drum, which may lower the rack 12 as the rack slides along the track 36. Desirably, this rotation of the drum may help the rack 12 to be positioned at any of a substantially continuous range of heights, if desired.

The winch 64 is preferably motor-driven and may include motor and a remote control device 68. The motor may be an electric motor, a gas-powered motor and/or any other suitable motor. The remote control device 68 may be configured to cause the motor to raise and/or lower the rack 12 by, for example, actuating one or more buttons on the remote control device. For instance, the remote control device 68 may be configured to cause the motor to rotate the winch's drum to raise and/or lower the rack 12.

The remote control device 68 may be configured to control the motor via a wired connection or a wireless connection depending, for example, upon the particular configuration of the remote control device 68 and the motor. It will be appreciated, however, that the motor does not require a remote control device 68.

The motor may have an automatic shut-off feature. In particular, the motor may be configured to automatically stop raising the rack 12, for example, when the rack reaches a predetermined maximum height, when the rack reaches a predetermined minimum height, and/or when a predetermined amount of resistance to the rack's movement is sensed. Desirably, this may provide an automatic braking feature. It will be appreciated, however, that the winch 64 does not require a motor and that the winch may be manually driven, if desired.

As shown in FIG. 3, the winch 64 may be supported by a shelf 70, which may be connected to the rack 12 and/or the mount 30. The shelf 70 may form part of an enclosure (not shown), which may help protect portions of the winch 64, if desired. A light 72 may be connected to the shelf 70 and/or any other portion of the storage system 10, if desired.

The rack 12, the saddle supports 14, the pad supports 18, the base 26; the gussets 28; the mount 30; the track 36; the frame 38; the brace 42; the brackets 40, 46, 50, 60; and the shelf 72 are preferably constructed from metal (for instance, aluminum or steel) and may also include a finish, such as paint, powder coat, undercoat, and/or other suitable finishes. However, the rack 12, the saddle supports 14, the pad supports 18, the base 26; the gussets 28; the mount 30; the track 36; the frame 38; the brace 42; the brackets 40, 46, 50, 60; the shelf 72; and/or any portions thereof may be constructed from metal, plastic, fiberglass, wood, and/or any other suitable material and do not require any finish.

Although this invention has been described in terms of certain preferred embodiments, other embodiments apparent to those of ordinary skill in the art are also within the scope of this invention. Accordingly, the scope of the invention is intended to be defined only by the claims which follow.

What is claimed is:

1. A storage system for storing and organizing one or more saddles used for riding animals in a trailer, the storage system comprising:

a mounting system movable between an extended position and a retracted position relative to a support structure, the mounting system comprising:

a frame sized and configured to be connected to the support structure; and a track connected to the frame, the track being generally vertically disposed with an upper end and a lower end;

a saddle rack comprising:

a base slidably coupled to the track of the mounting system to allow the saddle rack to be raised and lowered at a plurality of heights relative to the track;

a first saddle support connected to the base;

a first pad support connected to the base, the first saddle support and the first pad support being spaced apart by a distance;

a second saddle support connected to the base; and a second pad support connected to the base, the second saddle support and the second pad support being spaced apart by a distance;

wherein the first saddle support, the first pad support, the second saddle support and the second pad support are spaced apart by a generally fixed distance; and wherein, when the saddle rack is in a lowered position, a lower end of the base is disposed below the lower end of the track; and a height adjustment device sized and configured to position the saddle rack at a plurality of heights along the track;

wherein the saddle rack is disposed above a floor of the trailer when the mounting system is in the retracted position; and wherein the lower end of the base is disposed below the floor of the trailer when the mounting system is in the extended position and the saddle rack is disposed in the lowered position.

2. The storage system as in claim 1, wherein the height adjustment device comprises a winch.

3. The storage system as in claim 1, wherein, when the saddle rack is in the lowered position, the lower end of the base is spaced below the lower end of the track by a distance.

4. The storage system as in claim 1, wherein the lower end of the base is disposed below the floor of the trailer to facilitate loading and unloading of the saddle rack.

5. The storage system as in claim 1, further comprising a distance separating the lower end of the base from the lower end of the track when the saddle rack is in the lowered position; and wherein an upper end of the base is spaced apart from the upper end of the track by the same distance when the saddle rack is in the lowered position.

6. A storage system for storing and organizing one or more saddles used for riding animals in a trailer, the storage system comprising:

a mounting system comprising:

a frame sized and configured to be connected to a support structure; and a track connected to the frame; and a saddle rack sized and configured to move between an extended position and a retracted position relative to the support structure, the saddle rack sized and configured to move between a plurality of heights when the saddle rack is in the extended position, the saddle rack comprising:

a base coupled to the track, a lower end of the base being disposed below and spaced apart from a lower end of the track when the saddle rack is in a lowered position;

a first saddle support connected to the base; and a second saddle support connected to the base, the first saddle support and the second saddle support being spaced apart by a fixed distance;

wherein the first saddle support and the second saddle support are spaced apart by the same fixed distance when the saddle rack is moved between the plurality of heights;

wherein the saddle rack is disposed above a floor of the trailer when the mounting system is in the retracted position; and wherein at least a portion of the saddle rack is disposed below the floor of the trailer when the mounting system is in the extended position and the saddle rack is disposed in the lowered position.

7. The storage system as in claim 6, further comprising a receiving portion of the base that receives a portion of the track.

8. The storage system as in claim 7, wherein the receiving portion is formed by one or more brackets connected to the base of the saddle rack.

9. The storage system as in claim 6, wherein an upper end of the base is disposed below an upper end of the track when the saddle rack is in the lowered position.

10. The storage system as in claim 6, further comprising a distance separating the lower end of the base from the lower end of the track when the saddle rack is in the lowered position; and wherein an upper end of the base is spaced apart from an upper end of the track by the same distance when the saddle rack is in the lowered position.

11. The storage system as in claim 6, wherein when the saddle rack is in the lowered position it facilitates loading and unloading of the saddle rack.

12. The storage system as in claim 6, further comprising a height adjustment device sized and configured to position the saddle rack at a plurality of heights.

13. The storage system as in claim 12, wherein the height adjustment device comprises a winch.

14. The storage system as in claim 6, wherein at least a substantial portion of the saddle rack is disposed within the trailer when the saddle rack is in the retracted position; and wherein at least a substantial portion of the saddle rack is disposed outside the trailer when the saddle rack is in the extended position.

15. The storage system as in claim 6, further comprising:

a first pad support connected to the base, the first saddle support and the first pad support being spaced apart by a distance; and a second pad support connected to the base, the second saddle support and the second pad support being spaced apart by a distance.

16. The storage system as in claim 15, wherein the first saddle support, the first pad support, the second saddle support and the second pad support are generally aligned in a vertical plane and spaced apart by a fixed distance.

* * * * *